US007275467B1

(12) United States Patent
Lee

(10) Patent No.: US 7,275,467 B1
(45) Date of Patent: Oct. 2, 2007

(54) TRACING MECHANISM OF TORQUE ADJUSTABLE WRENCHES

(76) Inventor: Chang Chuan Lee, No. 429, Jhong Jheng Rd., Caotlin Township, Nantou County (TW)

( * ) Notice: Subject to any disclaimer, the term of this patent is extended or adjusted under 35 U.S.C. 154(b) by 156 days.

(21) Appl. No.: 11/409,006

(22) Filed: Apr. 24, 2006

(51) Int. Cl.
*B25B 23/157* (2006.01)

(52) U.S. Cl. ..... 81/475; 81/467; 81/468

(58) Field of Classification Search ..... 81/467, 81/468, 475
See application file for complete search history.

(56) References Cited

U.S. PATENT DOCUMENTS 4,467,678 A * 8/1984 Lindholm ..... 81/483
6,722,235 B2 * 4/2004 Hsieh ..... 81/478
7,111,532 B2 * 9/2006 Wu ..... 81/478

* cited by examiner

*Primary Examiner*—Lee D. Wilson
*Assistant Examiner*—Shantese McDonald

(57) ABSTRACT

A torque adjustable wrench includes an adjusting rod extending from an end of the shank of the wrench and a first toothed surface are longitudinally defined in an outer periphery thereof. A longitudinal positioning groove is defined in the adjusting rod to form a blank area of the first toothed surface. An end cap is connected to the grip which is rotatably connected to the shank and includes second toothed surface which is engaged with the first toothed surface. A positioning member is connected to the end cap and includes a positioning tongue which can be removably engaged with the longitudinal positioning groove. When the torque is set, the grip is pulled to remove the positioning tongue from the longitudinal positioning groove and the user may operate the wrench. The use can trace the original setting by inserting the positioning tongue into the longitudinal positioning groove.

8 Claims, 10 Drawing Sheets

TRACING MECHANISM OF TORQUE ADJUSTABLE WRENCHES

FIELD OF THE INVENTION

The present invention relates to a torque adjustable wrench which includes a trip with a tracing mechanism which allows the user to trace the original setting of the torque.

BACKGROUND OF THE INVENTION

A conventional torque adjustable wrench is shown in FIGS. 8 and 9, and generally includes a shank 8 with first scale markings 81 marked on an end opposite to the wrench head (not shown) and a grip 7 is rotatably connected to the shank 8. The grip 7 includes a torque setting mechanism (not shown) received therein which has an adjusting rod 72. An end cap is connected to a distal end of the grip 7 and includes a toothed passage with which a toothed section 721 on the adjusting rod 72 is removably engaged. As shown in FIG. 8, the torque setting is zero and the user may set the torque to be output to be 2 as shown in FIG. 9. After the setting the completed, the grip 7 together with the end cap are pulled away from the shank 8 to let the toothed section 721 be disengaged from the toothed passage as shown in FIG. 9 so that the adjusting rod 72 will not be rotated again. The user then operates the wrench to output torque. However, during operation of the wrench, the grip 7 might be rotated relative to the shank 8. In some situations, the user forgets the original setting and the relative rotation of the grip 7 to the shank 8 makes the user difficult to remind the original setting.

FIG. 10 shows another conventional torque adjustable wrench 9 wherein the grip 92 is rotatably mounted to the shank 91. The grip 92 can be pulled to increase the length of the arm of force during operating the wrench. The grip 92 is rotatable relative to the shank 91 when operating the wrench and the original setting is lost.

The present invention intends to provide a tracing mechanism for a torque adjustable wrench and the original setting can be easily tracked no matter the grip is rotated or not.

SUMMARY OF THE INVENTION

The present invention relates to a torque adjustable wrench which comprises a shank having a first end with the wrench head connected thereto and a second end from which an adjusting rod extends. The adjusting rod has a first connection portion and a longitudinal positioning groove is defined in the first connection portion. A grip is mounted on the second end of the shank and rotatable about an axis of the shank. An end cap is connected to the grip and has a second connection portion which is removably connected to the first connection portion so as to rotate the adjusting rod. A positioning member is connected to the end cap and has a positioning tongue which is removably engaged with the longitudinal positioning groove.

The primary object of the present invention is to provide a tracing mechanism for the torque adjustable wrench wherein the user can trace the original setting even if the grip is rotated relative to the shank when operating the wrench.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
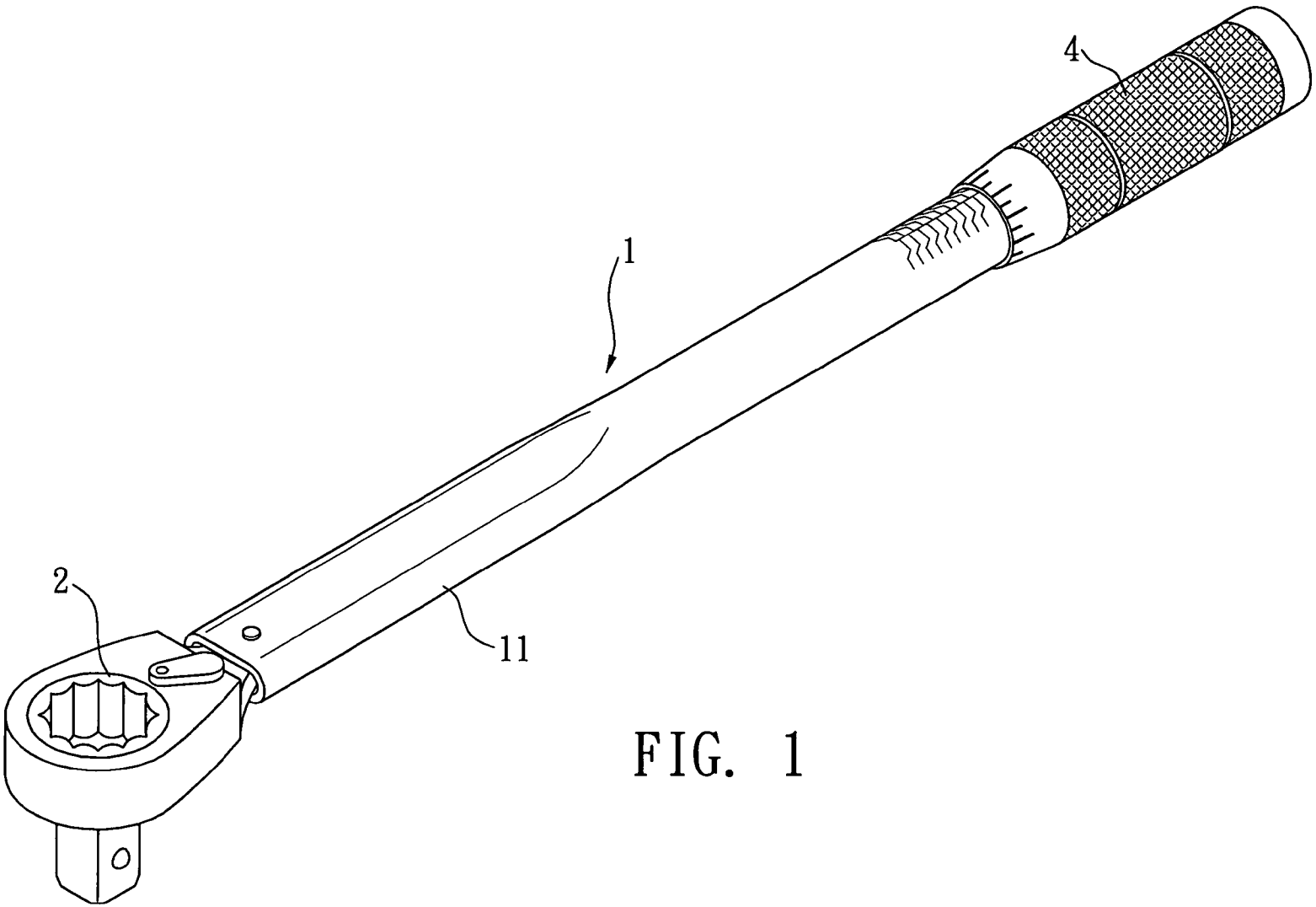
FIG. 1 is a perspective view to show the torque adjustable wrench with the tracing mechanism of the present invention.
Figure 2:
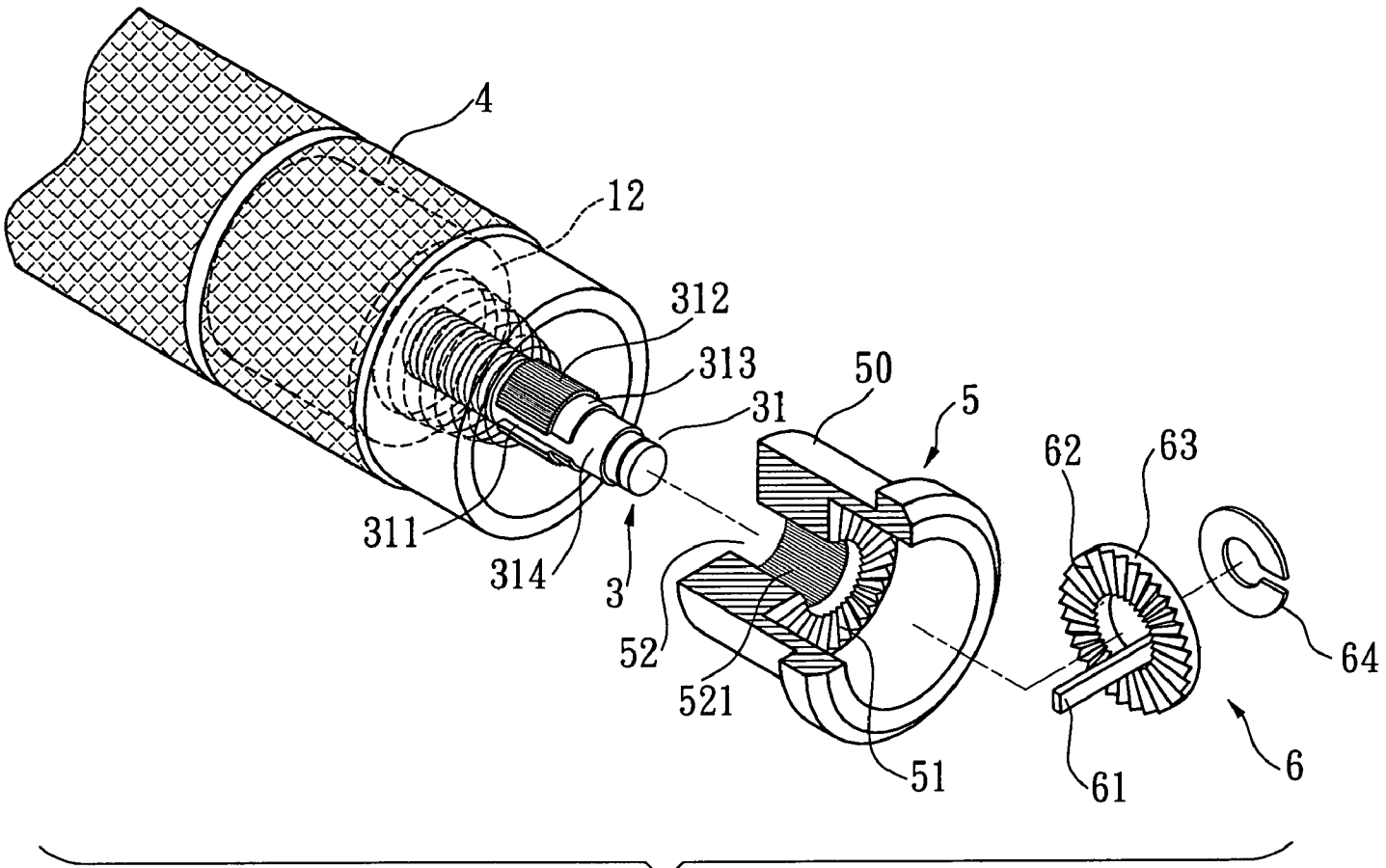
FIG. 2 is an exploded view to show the tracing mechanism of the present invention.

Referring to FIGS. 1 and 2, the torque adjustable wrench of the present invention comprises a shank 1 having a first end 11 with a wrench head 2 connected to the first end 11, and a second end 12 from which an adjusting rod 3 of a torque adjustable mechanism (not shown) extends. The adjusting rod 3 has a first connection portion 31 and a first toothed surface 312 is longitudinally defined in an outer periphery of the first connection portion 31. A longitudinal positioning groove 311 is defined in the first connection portion 31 and forms a blank area in the first toothed surface 312. A first stepped portion 313 and a second stepped portion 314 are formed on the outer periphery of the adjusting rod 3 wherein a diameter of the first stepped portion 313 is smaller than a diameter of the first toothed surface 312, and a diameter of the second stepped portion 314 is smaller than the diameter of the first stepped portion 313.

A grip 4 is mounted on the second end 12 of the shank 1 and rotatable about an axis of the shank 1.

An end cap 5 is connected to the grip 4 and has a second connection portion 50 which includes a through hole 52 and the through hole 52 includes a second toothed surface 521 defined in an inner periphery thereof. The first toothed surface 312 is removably engaged with the second toothed surface 521 so that when rotating the grip 4, the adjusting rod 3 is rotated and the user can set the desired torque by aligning the scale markings on the shank 1 and the grip 4.

A positioning member 6 is connected to the end cap 5 and has a positioning tongue 61 which is removably engaged with the longitudinal positioning groove 311 so as to limit relative rotation between the adjusting rod 3 and the end cap 5. The positioning member 6 has first teeth and the end cap 5 has second teeth which are removably engaged with the first teeth. The positioning member 6 has a first positioning portion 62 on one of two opposite sides thereof and, a second positioning portion 63 which is located on a periphery of the disk-like positioning member 6. The first teeth are defined in the first positioning portion 62 and the end cap 5 has a contact surface 51 which faces the first positioning portion 62, the second teeth are defined in the contact surface 51. A stop member 64 is connected to the end cap 5 and presses the positioning member 6 to the end cap 5.

Figure 3:
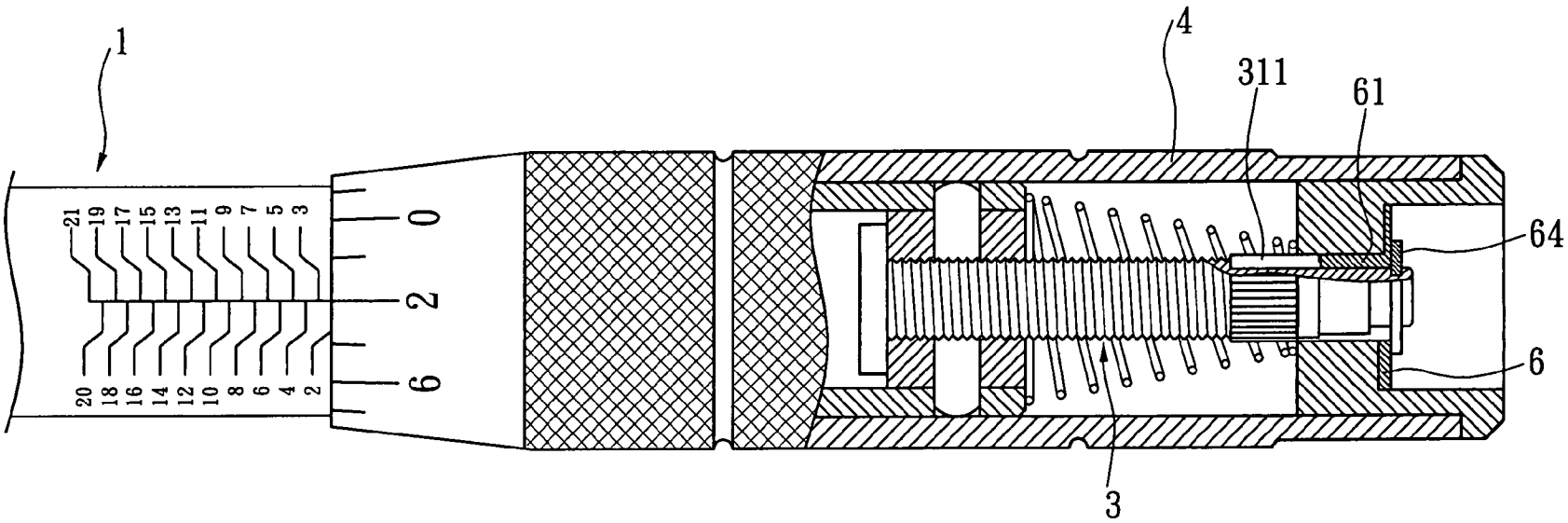
FIG. 3 is a cross sectional view of the tracing mechanism of the present invention, wherein the end cap is pulled and the positioning tongue is disengaged from the longitudinal positioning groove.
Figure 4:
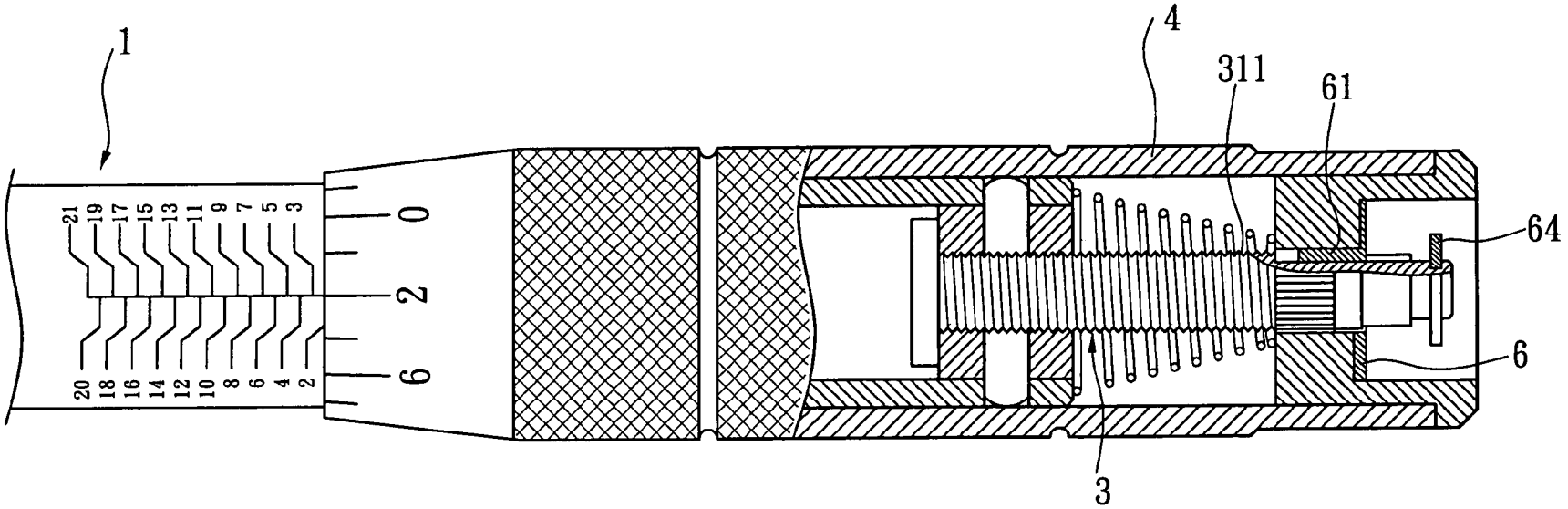
FIG. 4 is a cross sectional view of the tracing mechanism of the present invention, wherein the end cap is pushed back toward the shank and the positioning tongue is re-engaged with the longitudinal positioning groove.

Referring to FIGS. 3 and 4, if the torque setting is "2" as shown in the drawings, and the grip 4 is pulled away from the shank 1 to disengage the first toothed surface 312 from the second toothed surface 521. Therefore, the adjusting rod 3 does not rotated by rotation of the grip 4. The user then operates the wrench and during the operation, the grip 4 might rotate relative to the shank 1. After operation, as shown in FIG. 4, the user can trace the original setting by inserting the positioning tongue 61 into the longitudinal positioning groove 311. In order to re-engage the positioning tongue 61 with the longitudinal positioning groove 311, and assume that the grip 4 has rotated relative to the shank 1 during operation, the grip 4 has to be rotated back to its original position so that the original setting can be traced by checking the scale markings.

Figure 5:
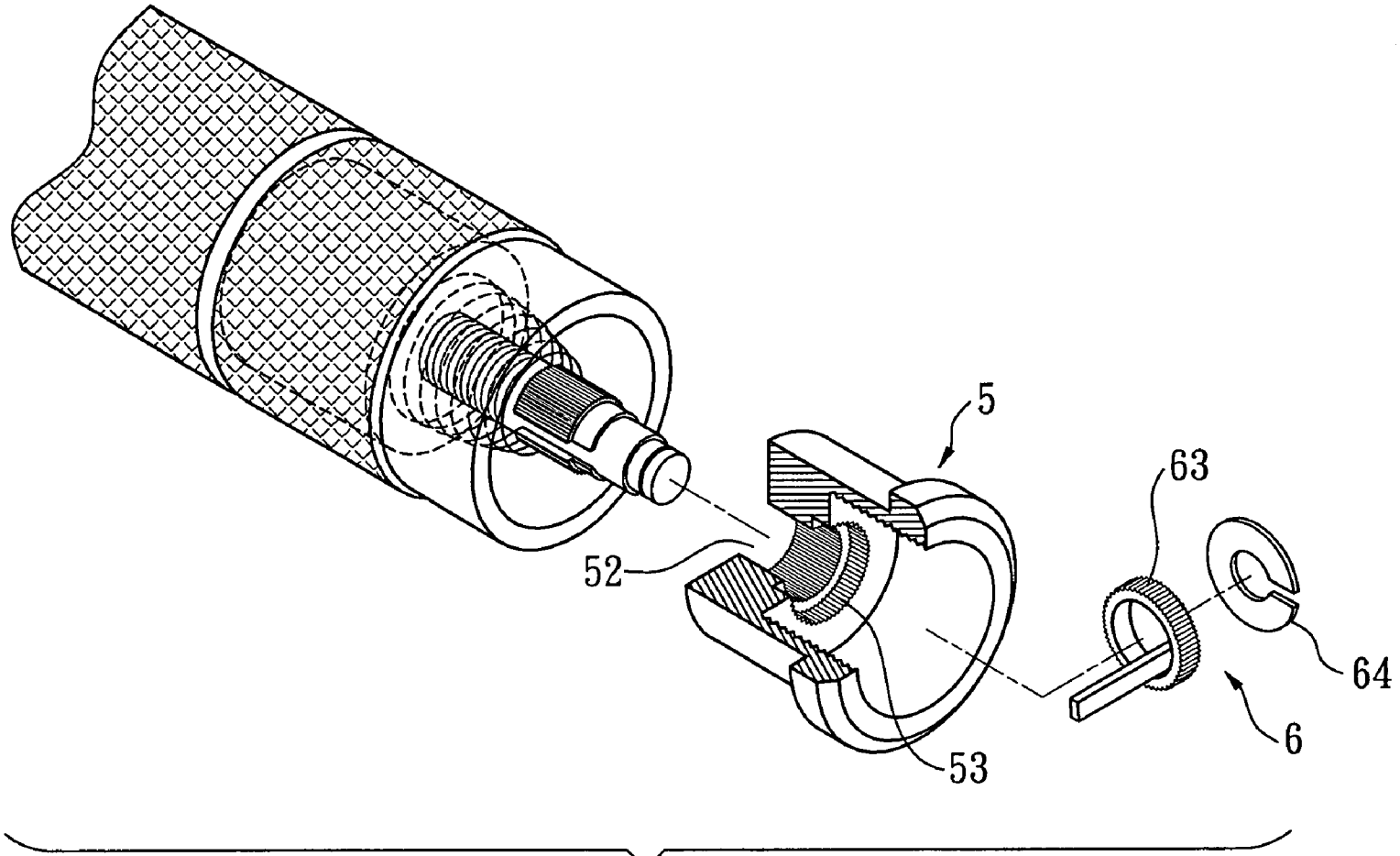
FIG. 5 shows a second embodiment of the tracing mechanism of the present invention.
Figure 6:
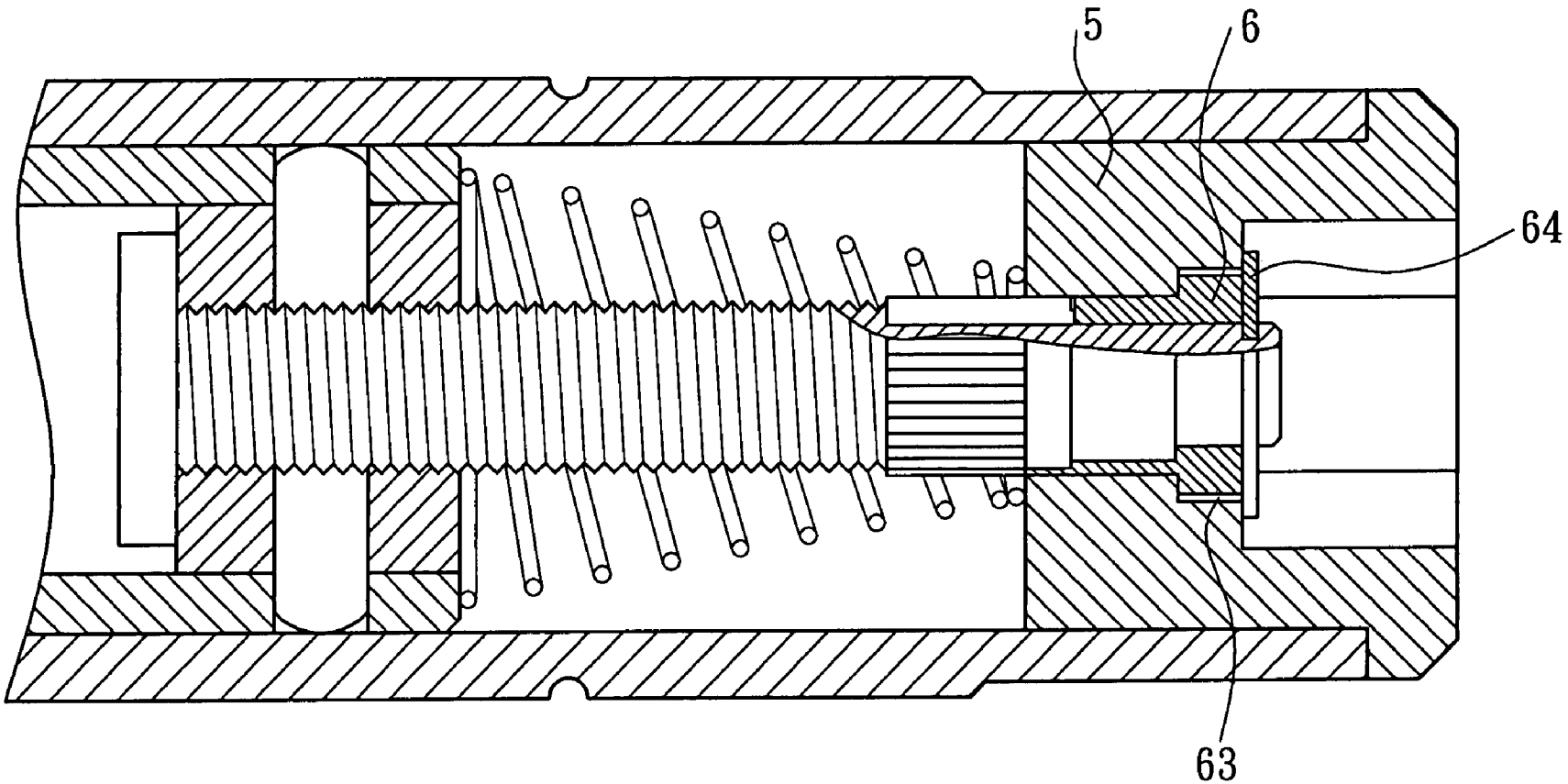
FIG. 6 is a cross sectional view of the tracing mechanism of the present invention in FIG. 5, wherein the end cap is pulled and the positioning tongue is disengaged from the longitudinal positioning groove.

Referring to FIGS. 5 and 6, second embodiment of the tracing mechanism of the present invention is disclosed. The first teeth can be defined in the second positioning portion 63 and the end cap 5 has an engaging surface 53 with which the second teeth of the end cap 5 are engaged.

Figure 7:
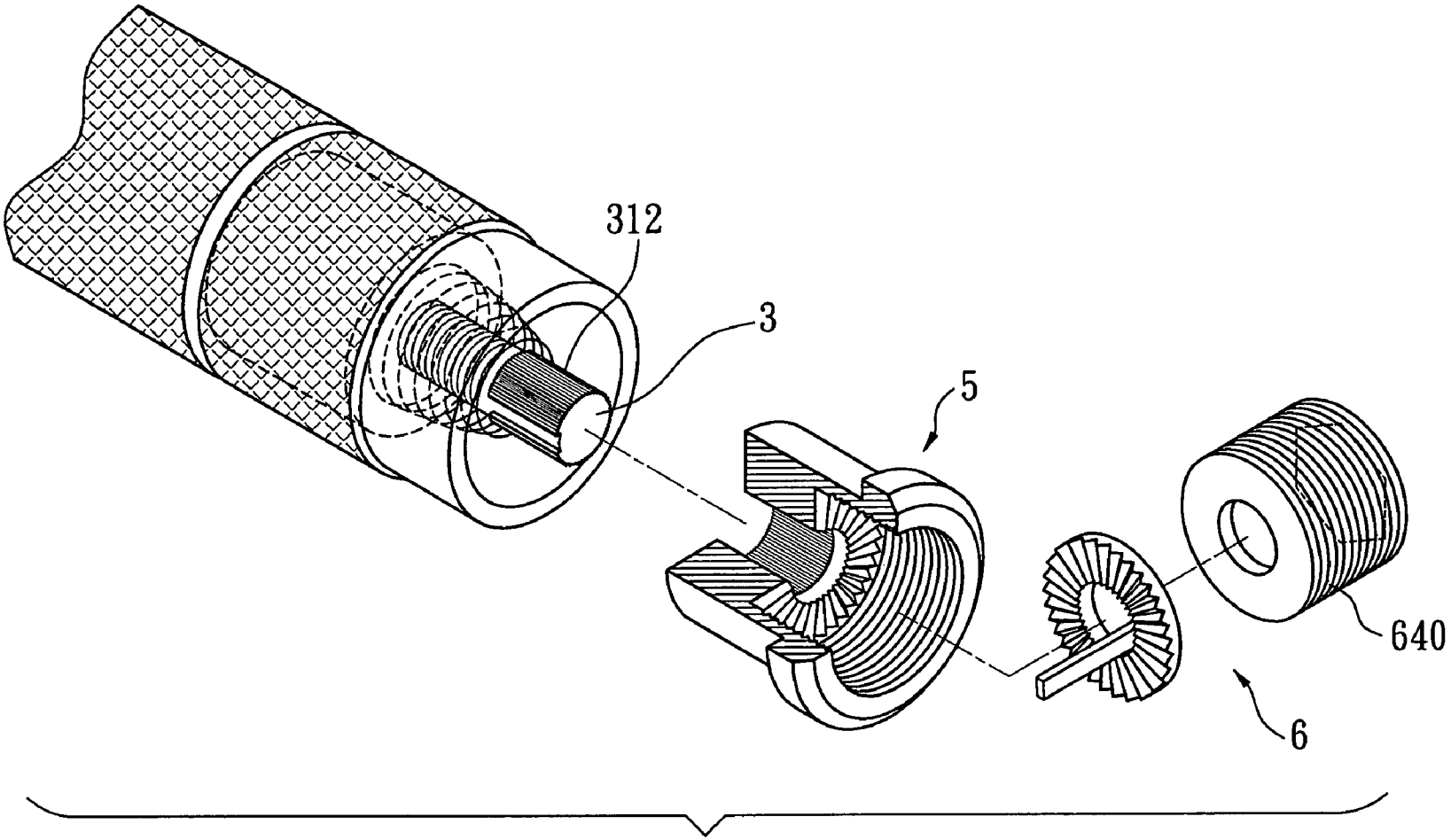
FIG. 7 shows a third embodiment of the tracing mechanism of the present invention.
Figure 8:
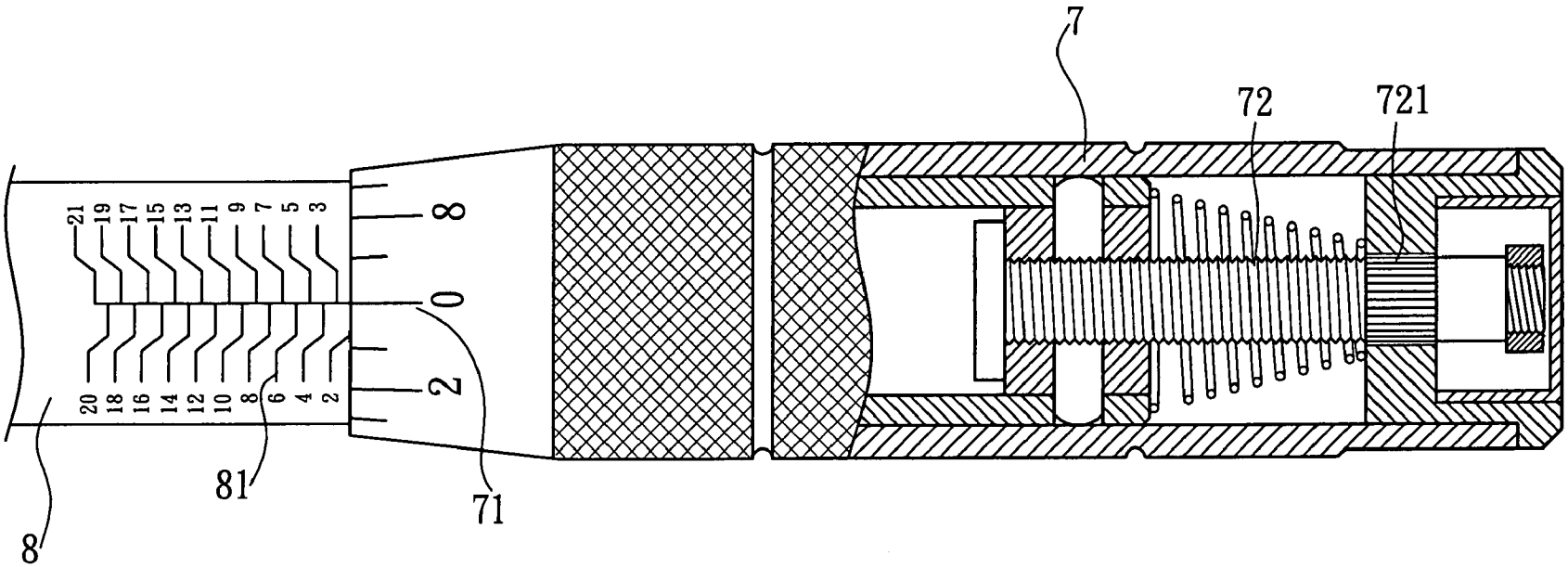
FIG. 8 PRIOR ART
FIG. 8 is a cross sectional view of a conventional torque adjustable wrench.
Figure 9:
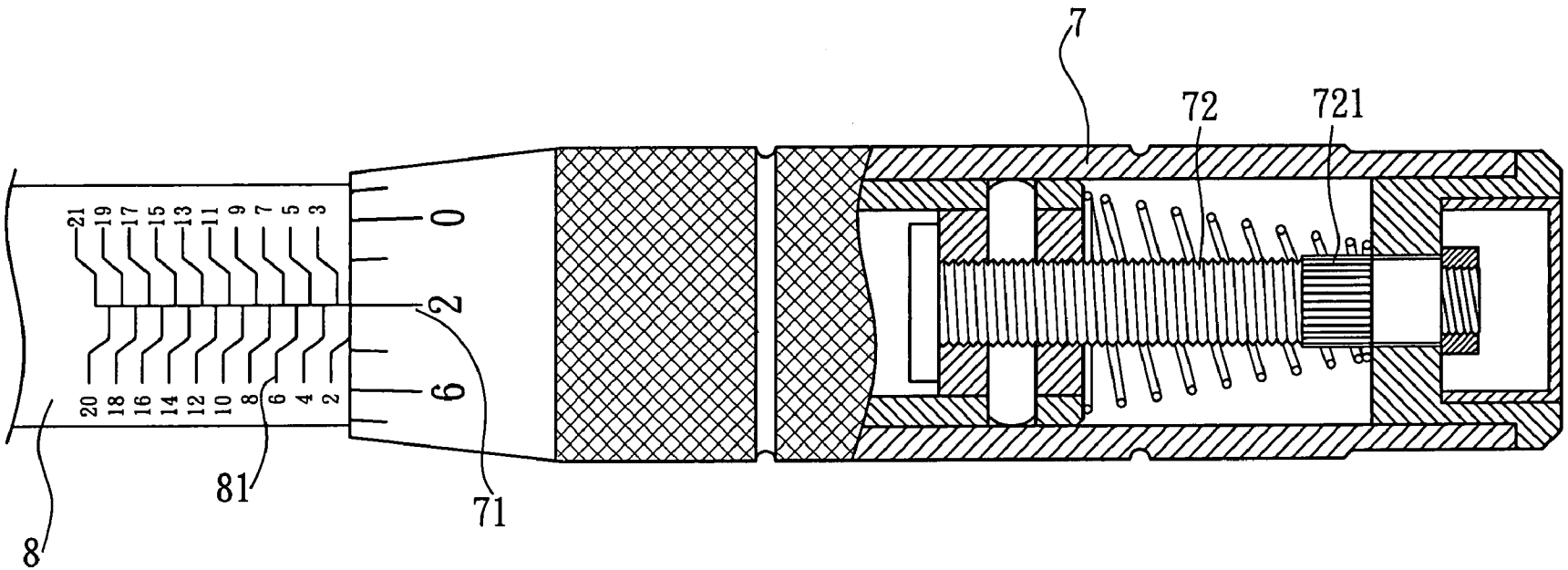
FIG. 9 PRIOR ART
FIG. 9 shows the end cap of the conventional torque adjustable wrench is pulled away from the shank.
Figure 10:
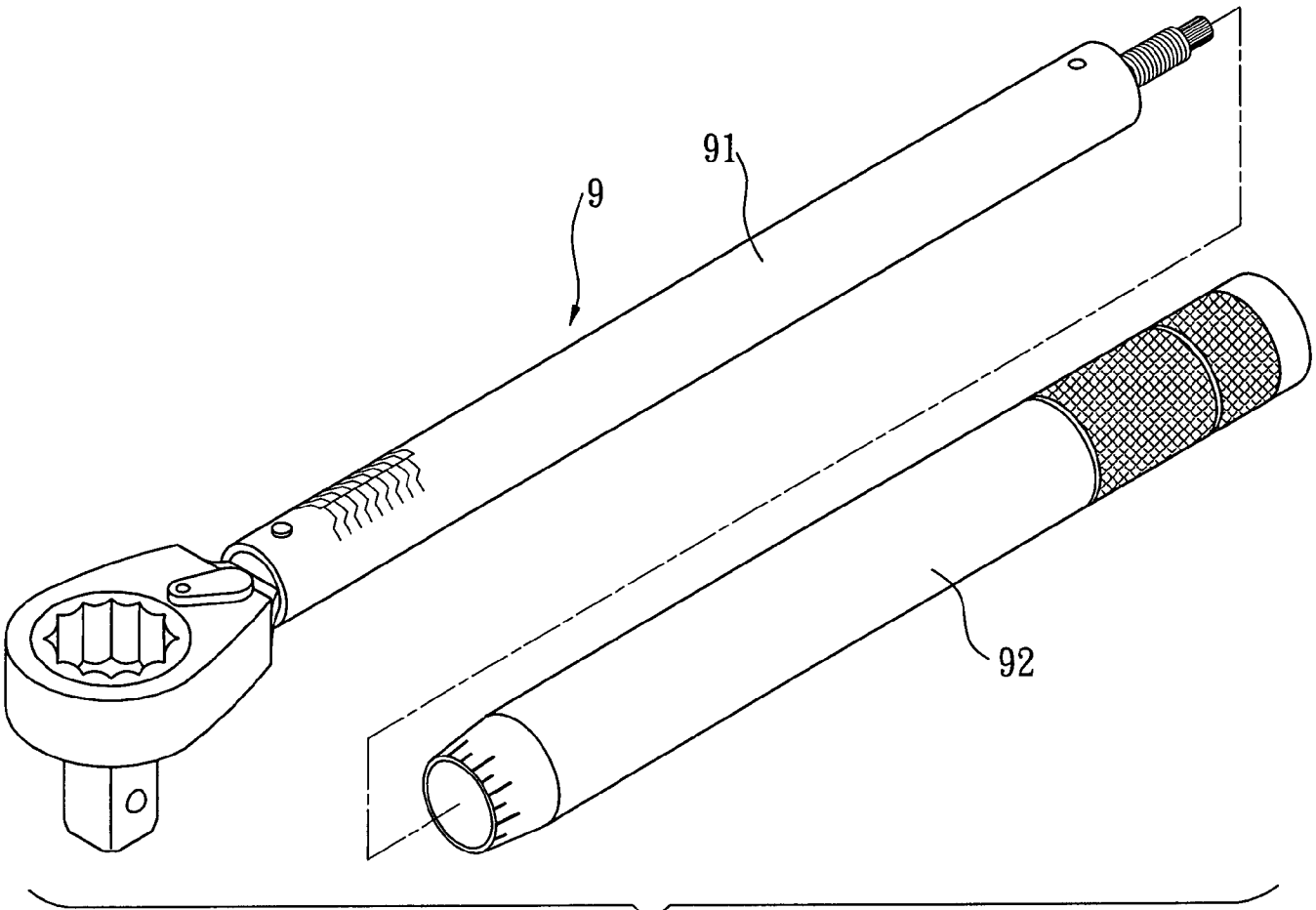
FIG. 10 PRIOR ART
FIG. 10 shows another conventional torque adjustable wrench.

FIG. 7 shows a third embodiment of the tracing mechanism of the present invention, wherein the adjusting rod 3 does not include the first stepped portion 313 and the second stepped portion 314 as disclosed in FIG. 2, and the first toothed surface 312 is defined in the outer periphery of the adjusting rod 3. A positioning piece 640 includes a threaded outer periphery and the end cap 5 has a threaded inner periphery which is threadedly connected to the threaded outer periphery of the positioning piece 640 so as to press the positioning member 6 to the end cap 5. The positioning piece 640 includes a polygonal hole defined in an end thereof so that the user may use a hand tool to rotate the positioning piece 640.

While we have shown and described the embodiment in accordance with the present invention, it should be clear to those skilled in the art that further embodiments may be made without departing from the scope of the present invention.

What is claimed is:

1. A torque adjustable wrench comprising:

a shank having a first end and a second end, an adjusting rod received in the shank and extending from the second end of the shank, the adjusting rod having a first connection portion and a longitudinal positioning groove defined in the first connection portion;

a grip mounted on the second end of the shank and rotatable about an axis of the shank;

an end cap connected to the grip and having a second connection portion which is removably connected to the first connection portion so as to rotate the adjusting rod, and a positioning member connected to the end cap and having a positioning tongue which is removably engaged with the longitudinal positioning groove so as to limit relative rotation between the adjusting rod and the end cap.

2. The wrench as claimed in claim 1, wherein the positioning member has first teeth and the end cap has second teeth which are removably engaged with the first teeth, the positioning member has a first positioning portion and a second positioning portion, one of the first positioning portion and the second positioning portion has the first teeth.

3. The wrench as claimed in claim 2, wherein the first teeth are defined in the first positioning portion and the end cap has a contact surface which faces the first positioning portion, the second teeth are defined in the contact surface.

4. The wrench as claimed in claim 2, wherein the first teeth are defined in the second positioning portion and the end cap has an engaging surface with which the second teeth of the end cap are engaged.

5. The wrench as claimed in claim 1, wherein the second connection portion of the end cap has a through hole and the first connection portion has a first toothed surface longitudinally defined in an outer periphery thereof, the through hole includes a second toothed surface defined in an inner periphery thereof, the first toothed surface is removably engaged with the second toothed surface.

6. The wrench as claimed in claim 5, wherein the adjusting rod includes a first stepped portion and a second stepped portion, a diameter of the first stepped portion is smaller than a diameter of the first toothed surface, a diameter of the second stepped portion is smaller than the diameter of the first stepped portion.

7. The wrench as claimed in claim 1 further comprising a stop member which is connected to the end cap and presses the positioning member to the end cap.

8. The wrench as claimed in claim 1 further comprising a positioning piece threadedly connected to the end cap so as to press the positioning member to the end cap.

* * * * *